United States Patent [19]

Terral

[11] 4,441,519

[45] Apr. 10, 1984

[54] GAS LIFT VALVE AND METHOD OF PRESETTING

[75] Inventor: Ben D. Terral, Houston, Tex.

[73] Assignee: Schlumberger Technology Corporation, New York, N.Y.

[21] Appl. No.: 346,811

[22] Filed: Feb. 8, 1982

[51] Int. Cl.[3] ..... F04F 1/20

[52] U.S. Cl. ..... 137/15; 137/155; 417/112

[58] Field of Search ..... 137/155, 15; 417/109, 417/112, 113

[56] References Cited

U.S. PATENT DOCUMENTS

| | | | |
|---|---|---|---|
| 2,892,415 | 6/1959 | McGowen | 137/155 X |
| 2,941,078 | 11/1959 | McGowen | 137/155 |
| 3,192,869 | 7/1965 | McCarvell | 137/155 |
| 4,239,082 | 12/1980 | Terral | 137/155 X |

OTHER PUBLICATIONS

*Composite Catalog of Oilfield Equipment and Services;* Gulf Publishing Co., 1978–1979, p. 1172.

*Primary Examiner*—Alan Cohan

[57] ABSTRACT

A gas lift valve having an adjustable stop for limiting valve stem travel such that the bellows may be preset to assure full valve opening in operation. To preset the valve, the stop is set so that the maximum stem travel is greater than that desired in operation, and an excess operating pressure is applied. The bellows is thereby permanently partially retracted so as to prevent the bellows from limiting stem travel to a distance less than the desired travel when the valve is in operation. The adjustable stop is repositioned to establish the operating stem travel before the valve is placed in use.

11 Claims, 7 Drawing Figures

.180
.160
.140
.120
.100
.080
.060
.040
.020
0
STEM TRAVEL (INCH)
550 570 590 610 630 650 670 690 710 730
CASING PRESSURE (PSI)
MAX. STEM TRAVEL AS PROVIDED BY MECHANICAL STOP
78
.018"
70
VALVE CLOSING
MAX. TRAVEL AS RESTRICTED BY BELLOWS STACK
72
68
VALVE OPENING

.180
.160
.140
.120
.100
.080
.060
.040
.020
0
STEM TRAVEL (INCH)
550 570 590 610 630 650 670 690 710 730
CASING PRESSURE (PSI)
76
78
VALVE CLOSING
74
VALVE OPENING

GAS LIFT VALVE AND METHOD OF PRESETTING

BACKGROUND OF THE INVENTION

1. The Field of the Invention

The invention relates to the structure of and methods of presetting bellows-type gas lift valves.

2. The Prior Art

A wide variety of bellows-type gas lift valves is known in the art, many of which include a fixed mechanical stop to limit the valve stem travel. Such a stop is desirable to prevent damage to the bellows in the event that an excessively high operating pressure is applied to the valve.

One example of a bellows-type gas lift valve having a mechanical stop is illustrated in U.S. Pat. No. 3,192,869, issued July 6, 1965, to McCarvell et al.

Other gas lift valves, such as the Camco type "BK" bellows-type valves, also have a mechanical stop for limiting the valve stem travel. In this type of valve, the stop is positioned prior to welding the bellows into the valve, and no provision is made for repositioning the stop after the bellows is affixed, i.e., during the bellows presetting operation.

It is known in the art to preset the bellows of a gas lift valve after assembly by overpressuring the valve. For example, a valve which is to have an operating pressure of 600–800 psi may be overpressured to, for example, 3500 psi. The purpose of presetting the bellows is to permanently deform the bellows so that the valve will open at the desired operating pressure. The purpose of presetting the bellows is to assure the operating pressure will not change if an excessive pressure is encountered in the well, say as high as 3500 psi.

Since it appears that the conventional presetting procedure described above does not cause sufficient compression of the bellows, the bellows will "stack up" at operating pressure, thereby limiting the stem travel before the mechanical stop is reached. Moreover, it has been found that stem travel is non-linear with applied pressure, and it would be desirable to make the relationship more nearly linear. Still further, the prior art valve assemblies and presetting methods do not provide entirely consistent operating pressure/stem travel characteristics from valve to valve. That is, some valves will fully open at a pressure differential which differs significantly from that required by other valves of the same construction and preset by the same process.

SUMMARY OF THE INVENTION

The present invention serves to minimize the above-mentioned disadvantages with prior art gas lift valve assemblies and methods of presetting.

In particular, the present invention offers a gas lift valve assembly having an adjustable stop. The stop may be preset to allow greater valve stem travel during the presetting process than during normal operation of the valve. This permits the bellows to be preset by causing the valve stem to travel a greater distance than it will travel during normal operation of the valve, and thereby permanently partially compressing the bellows. After presetting, the stop is adjusted to define the maximum travel of the valve stem during normal valve operation. Application of normal operating pressure will thereafter cause the valve stem to open until the stop is reached. The bellows will thus not "stack up," or prevent full travel of the valve stem as with prior art arrangements.

THE PREFERRED EMBODIMENT

Figure 1A:
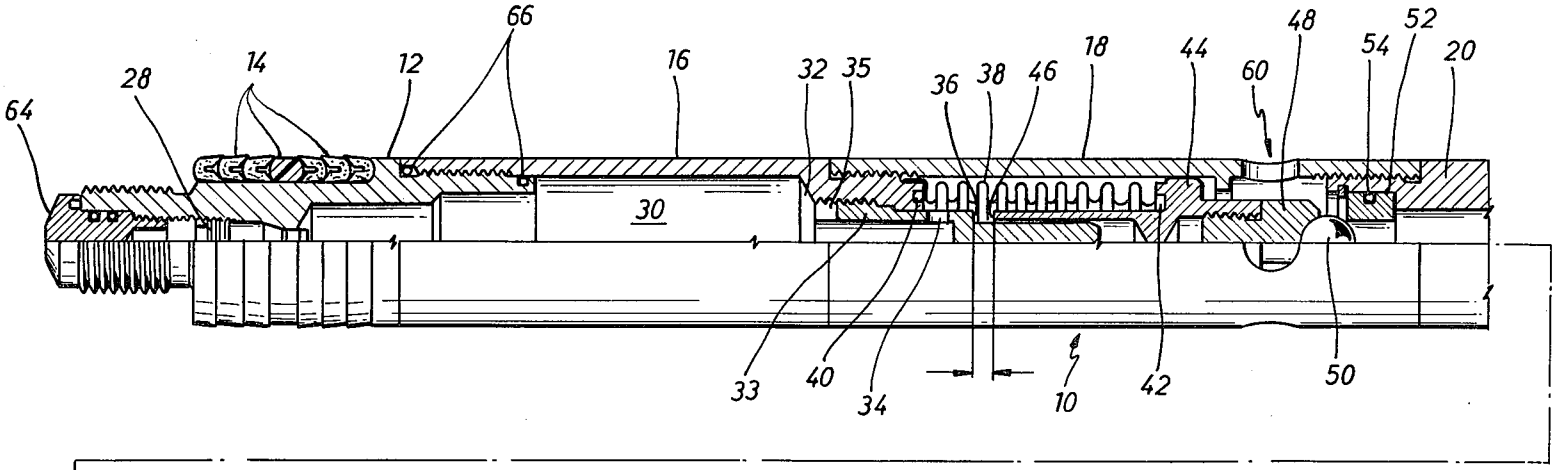
FIGS. 1A and 1B show partial cutaway views of upper and lower sections of a gas lift valve in accordance with the invention, respectively.
Figure 1B:
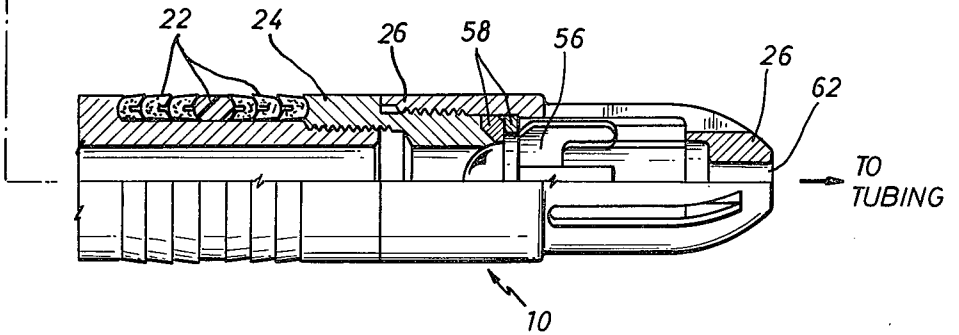

FIGS. 1A–1B show respective upper and lower sections of a preferred gas lift valve 10 in accordance with the present invention. Valve 10 has a valve core housing 12 fitted with an upper packing 14 and threadedly engaging a generally cylindrical bellows top 16. A tubular casing member 18 is threadedly mounted between the other end of bellows top 16 and a seat housing 20 fitted with a lower packing 22. Check seat 24 is threaded to the seat housing 20 and to a nose piece 26.

A Dill valve core (or other suitable valve) 28 closes off an orifice in the upper end of valve core housing 12, to define a pressure chamber 30. Pressure chamber (or dome) 30 is charged with a gas, such as nitrogen, as is well known in the art. It is also well known to provide a fluid, such as a viscous silicone oil, in the pressure chamber. The oil may, for example, fill the bellows and the lower region of the pressure chamber up to the vicinity of bevelled shoulder 32.

Threadedly mounted in an orifice at the lower end of bellows top 16 is an adjustable stop member 33. Stop member 33 has an opening 34 to permit communication of the interior of bellows 38 with pressure chamber 30. Stop member 33 has a slot 35 (or other suitable configuration) at its upper end to permit a tool to engage and rotate stop member 33 for adjustment of stem travel as will be explained further below. Stop member 33 also has a downwardly facing shoulder 36.

Bellows 38 is welded (silver soldered) at 40 to bellows top 16 and at 42 to the valve stem assembly. The valve stem assembly comprises a bellows adaptor 44 having an upper end 46. A stem tip 48 is threaded to bellows adaptor 44 and has a ball 50 welded to its lower end. Controlled ball 50 engages a valve seat member 52 having a circumferential O-ring 54. Valve seat member 52 is sealingly mounted within seat housing 20 and rests at its lower end against a shoulder.

FIG. 1B shows a check dart 56 having a check ball and downwardly extending fins. Check dart 56 engages a check seat and seal assembly 58 and, in conventional fashion, prevents flow into the gas lift valve 10 through nose piece 26.

Valve 10 has an inlet port 60 for receiving casing pressure and an outlet port 62 which communicates with the production tubing of a well when the valve 10 is suitably mounted in a gas lift mandrel. A seal plug 64 is threaded into the upper end of the valve core housing 12 above the valve core 28. It will be appreciated that the valve configuration shown in FIGS. 1A–1B is a wireline retrievable-type valve for service in side pocket mandrels. Those of skill in the art will recognize that the lower portion of the valve assembly shown in FIG. 1B may be replaced with a threaded connection for permanent installation in a conventional gas lift mandrel.

Figure 2A:
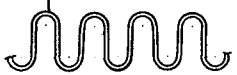
FIGS. 2A–2C show partial sectional views of a bellows in fully extended, fully retracted, and "preset" conditions, respectively.
Figure 2B:
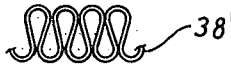

FIG. 2A shows in enlarged view a section of bellows 38 in its original, fully-extended position. FIG. 2B shows the same section of bellows (designated as 38') in fully compressed state, that is, with the bellows "stacked up." It will be recognized that, when sufficient operating pressure is applied to port 60, the valve stem assembly will move upwardly until either the upper stem end 46 abuts stop shoulder 36 or until the bellows stacks up as shown in FIG. 2B. If the bellows stacks up (as in FIG. 2B) before the valve stem assembly has traveled a sufficient distance, the flow orifice between controlled ball 50 and valve seat 52 will be partially restricted.

Figure 2C:
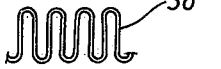

Accordingly, the present invention contemplates backing off the stop member 33 to increase the maximum travel of the valve stem assembly during the presetting operation. Application of operating pressure to port 60 causes the bellows to first stack up as shown in FIG. 2B, and then (upon application of sufficient excess operating pressure) to permanently partially compress the bellows. Such excess operating pressure causes the bellows to be compressed until stem end 46 contacts stop shoulder 36. Relieving the operating pressure allows the bellows to re-extend to a partially-compressed length as illustrated in FIG. 2C. The adjustable stop member 33 is then rotated to establish the maximum stem travel 34 desired in operation of the valve in a well.

It will be recognized that merely applying an excess operating pressure to the valve without adjusting the stop to increase stem travel during the presetting operation will not sufficiently deform (i.e., permanently compress) the bellows to prevent bellows "stack up" when the valve is placed in operation.

An important feature of the preferred embodiment illustrated in FIGS. 1A–1B is that the pressure chamber 30 is defined by the valve core housing 12 and the bellows top 16. Since it is necessary to engage slot 35 of stop member 33 with a screwdriver or similar device during the presetting operation, it is necessary that access be provided for this purpose. Accordingly, the valve core housing 12 is disengaged from the threads in the bellows top 16 during the presetting operation. Once the bellows is preset as described above, valve core housing 12 is threaded to bellows top 16 and sealed with O-rings 66. Alternatively, O-rings 66 may be replaced with welded (silver soldered) connections to make the pressure dome 30 and stop member 33 of the valve assembly tamper-proof in the field.

Figure 3A:
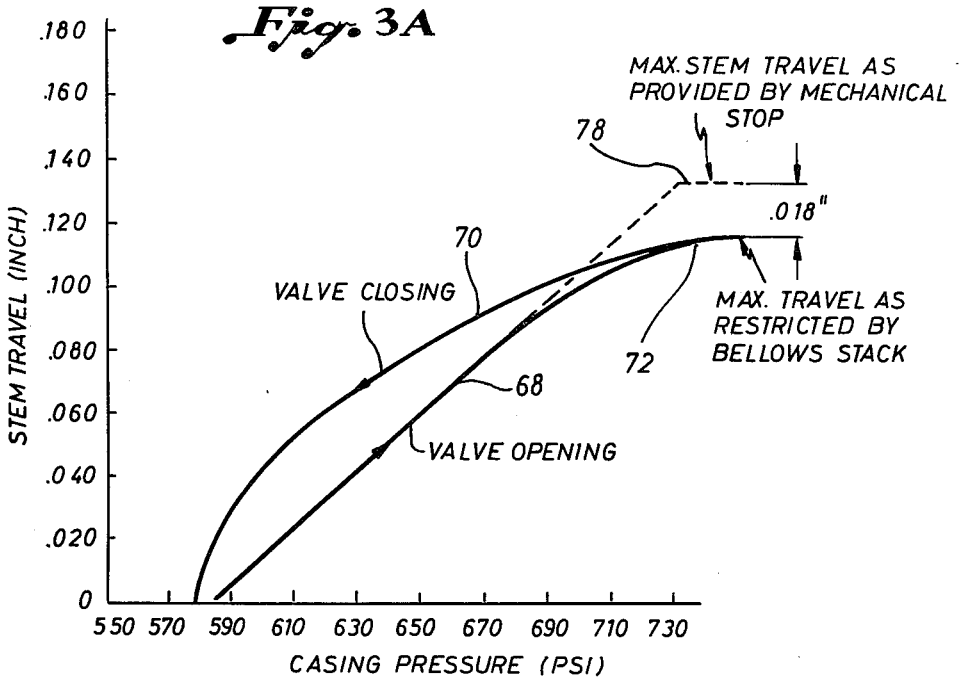
FIGS. 3A–3B are graphs showing results of static probe tests which illustrate the advantages of the present invention.
Figure 3B:
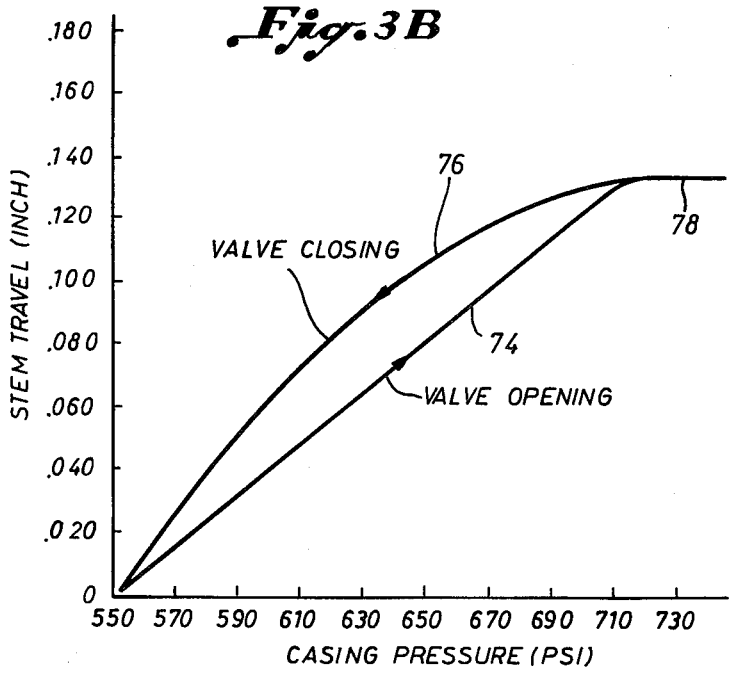

FIGS. 3A and 3B show graphically the results of comparison tests of "preset" gas lift valves. Valves as illustrated in FIGS. 1A–1B were first adjusted so that the stop member 33 would permit 0.134 inch stem travel nom. An excess operating pressure of 3500 psi was applied to each valve to "preset" the bellows. The valves were then tested by application of normal operating pressure of between about 550 and 750 psi. FIG. 3A shows that the valve opening (line 68) commenced at just below 590 psi, and that the maximum stem travel at an operating pressure in excess of 730 psi was about 0.116 inch. As pressure was reduced, the valve closing (line 70) was somewhat less linear than the valve opening, providing an operating hysteresis as shown in FIG. 3A.

Identical valves were then preset by backing out the stop member 33 by 0.075 inch, allowing total stem travel of 0.209 inch. An excess operating pressure of 3500 psi was applied. After presetting, the stop was returned to its normal position (0.134 inch travel nom). When the valves preset in this fashion were tested at normal operating pressures, it was found that the valve opening (line 74) was more nearly linear over an opening range of 550–720 psi as shown in FIG. 3B. The valve closing (line 76) was also more nearly linear. Moreover, the maximum valve stem travel was about 0.018 inch greater than that of the valves preset without adjustment of the stop member 33, as indicated in FIG. 3A.

Adjustment of the stop during the presetting operation in accordance with the invention provides several advantages. First, the bellows is preset so as to prevent bellows "stack up" from limiting valve stem travel. Second, the maximum stem travel can be more accurately predicted, thereby assuring full opening of the valve and avoiding restriction of the flow orifice. Third, the operating hysteresis in the pressure/stem travel characteristic of the valve is somewhat reduced and the valve opening response is made more nearly linear with pressure. Fourth, the opening and closing characteristics are more consistent from valve to valve.

A novel preferred gas lift valve construction and method of presetting the valve have now been described with reference to the drawings. Those of skill in the art will recognize that numerous variations and modifications may be made within the spirit and scope of the invention. Accordingly, the foregoing is not intended to limit the invention as defined in the following claims.

I claim:

1. A method of presetting a bellows-type gas lift valve having a valve stem coupled to a bellows and operable upon retraction of the bellows to open a flow orifice in response to applied operating pressure, comprising the steps of:

limiting the travel of said valve stem to a first distance sufficient to permanently partially retract the bellows;

causing said valve stem to travel said first distance; and subsequently limiting the travel of said valve stem to a second distance which is less than said first distance, said second distance being such that said valve stem will travel said second distance upon application of a predetermined normal operating pressure.

2. The method of claim 1, wherein said step of causing said valve stem to travel said first distance comprises applying to said valve an excess operating pressure of substantially greater magnitude than said normal operating pressure.

3. The method of claim 1, wherein said first distance is approximately one and one-half times the magnitude of said second distance.

4. The method of presetting the length of the bellows in a bellows-type gas lift valve assembly of the type having a valve stem operable to partially collapse the bellows while opening a valve orifice in response to applied operating pressure, and having a mechanical stop for limiting the travel of the valve stem, comprising the steps of:

locating said mechanical stop to establish a first maximum stem travel distance;

applying an excess operating pressure substantially greater than the normal operating pressure to be applied to the valve when placed in gas lift service and such that said valve stem travels said first maximum stem travel distance, thereby reducing the length of said bellows; and relocating said mechanical stop to establish a second maximum stem travel distance of lesser magnitude than said first maximum stem travel distance;

whereby said bellows is preset to a length such that, when normal operating pressure is applied to the valve, said bellows will not restrict said stem from traveling said second maximum stem travel distance.

5. The method of claim 4, wherein said first stem travel distance is approximately one and one-half times the magnitude of said second travel distance.

6. The method of claim 4, wherein said excess operating pressure is approximately 4 to 6 times as great as said normal operating pressure.

7. The method of claim 4, wherein said excess operating pressure is on the order of 3500 psi and said normal operating pressure is on the order of 600–800 psi.

8. A gas lift valve assembly, comprising:

a pressure chamber;

a bellows having a first end sealingly coupled to and in communication with said pressure chamber, and a second end;

a valve seat opposed to said bellows;

a valve stem coupled to the second end of said bellows and movable toward said valve seat when said bellows is extended and away from said valve seat when said bellows is retracted in response to an applied operating pressure; and stop means for limiting the travel distance of said valve stem away from said valve seat, said stop means being movable to define first and second travel distances of said valve stem; said bellows being preset by the application of excess operating pressure to cause said valve stem to travel said first travel distance, so that said bellows is permanently partially compressed to a length which permits said valve stem to travel said second travel distance in response to an operating pressure of substantially lesser magnitude than said excess operating pressure without limitation due to bellows stack-up.

9. The gas lift valve assembly of claim 8, wherein said stop means comprises a stop member threadedly coupled to said pressure chamber

10. The gas lift valve assembly of claim 9, wherein said pressure chamber comprises a bellows top coupled to the first end of said bellows and a housing sealingly coupled to said bellows top.

11. The gas lift valve assembly of claim 10, wherein said housing is removable to provide access for moving said stop member to define the travel distance of said valve stem.

* * * * *